US012078065B2

(12) United States Patent
Wei et al.

(10) Patent No.: US 12,078,065 B2
(45) Date of Patent: Sep. 3, 2024

(54) TELESCOPIC DEVICE AND TELESCOPIC ANNULAR TUNNEL STEEL ARCH

(71) Applicant: ZHEJIANG UNIVERSITY CITY COLLEGE, Zhejiang (CN)

(72) Inventors: Xinjiang Wei, Zhejiang (CN); Zeyu Cheng, Zhejiang (CN); Hongshui Zhu, Zhejiang (CN); Shiming Du, Zhejiang (CN); Jun Zhao, Zhejiang (CN); Yun Wang, Zhejiang (CN); Hanhua Zhu, Zhejiang (CN); Tongchun Han, Zhejiang (CN)

(73) Assignee: ZHEJIANG UNIVERSITY CITY COLLEGE, Hangzhou (CN)

( * ) Notice: Subject to any disclaimer, the term of this patent is extended or adjusted under 35 U.S.C. 154(b) by 0 days.

(21) Appl. No.: 18/242,545

(22) Filed: Sep. 6, 2023

(65) Prior Publication Data

US 2024/0167383 A1 May 23, 2024

Related U.S. Application Data

(63) Continuation of application No. PCT/CN2023/080210, filed on Mar. 8, 2023.

(30) Foreign Application Priority Data

Nov. 21, 2022 (CN) ..... 202211452967.4

(51) Int. Cl.
*E21D 11/22* (2006.01)
*E21D 11/18* (2006.01)

(52) U.S. Cl.
CPC ..... *E21D 11/22* (2013.01); *E21D 11/18* (2013.01)

(58) Field of Classification Search
CPC ..... E21D 11/22; E21D 11/18
See application file for complete search history.

(56) References Cited

FOREIGN PATENT DOCUMENTS

CN 113006834 A * 6/2021 ..... E21D 11/22
CN 115306448 A * 11/2022

* cited by examiner

*Primary Examiner* — Janine M Kreck

(57) ABSTRACT

A telescopic device includes a first U-shaped connector with a plurality sets of adjustment slots defined in two sides thereof and arranged along an adjustment direction; a second U-shaped connector defining first through holes in two sides thereof, the second U-shaped connector being inserted into the first U-shaped connector with U-shaped openings thereof opposite to each other to define an accommodating space; a first spring located in the accommodating space and abutting against the first and second U-shaped connectors, respectively; an elastic pin with two ends thereof extending through the first through holes and engaging into one of the plurality sets of adjustment slots; and an initial fixing pin being detachably connected to the first and second U-shaped connectors. A telescopic annular tunnel steel arch includes an upper arch, two lower arches and two telescopic devices connecting two ends of the upper arch to the two lower arches, respectively.

10 Claims, 6 Drawing Sheets

TELESCOPIC DEVICE AND TELESCOPIC ANNULAR TUNNEL STEEL ARCH

CROSS-REFERENCE TO RELATED APPLICATIONS

This application is a continuation application of International Patent Application No. PCT/CN2023/080210, filed Mar. 8, 2023, which claims priority to Chinese Patent Application No. 202211452967.4, filed on Nov. 21, 2022, the entire contents of which are hereby incorporated by reference.

TECHNICAL FIELD

The present application relates to the technical field of tunnel support, in particular to a telescopic device and a telescopic annular tunnel steel arch.

BACKGROUND

With the rapid development of transportation facilities such as high-grade highways and railways in China, a large number of tunnel constructions have emerged, wherein the design of support systems during tunnel excavation is of great significance for ensuring the safety of tunnels. When a super long tunnel passes through high crustal stress areas such as mountains, due to the influence of terrain, crustal stress redistribution and groundwater distribution range, the confining pressure increases and thus the tunnel is prone to geological disasters such as large deformation of the surrounding rocks. At the same time, under high crustal stress conditions, the tunnel is weak and the surrounding rocks have poor self-support capacity, which is prone to large deformation of the tunnel. The stability control of the surrounding rocks and the design of support solutions have become a challenge for tunnel construction safety control.

Rigid arch, as a mature technology for support of the surrounding rocks, is currently widely used in tunnel constructions. However, project practice indicates that the support manner of "Use Strength to Conquer Strength" has not achieved the expected support effect in soft rock tunnels, mainly manifested in the difficulty of rigid arch in suppressing large deformation of the surrounding rocks, and its control effect on tunnel stability is very limited.

Therefore, for layered soft rock tunnels, rigid support cannot be simply used to stabilize the surrounding rocks. It is necessary to change the support concept and seek new methods for soft rock tunnel support.

SUMMARY

An object of embodiments of the present application is to provide a telescopic device and a telescopic annular tunnel steel arch, which can make the steel arch better adapt to the pressure of surrounding rocks, thereby improving the overall stability of the steel arch.

On a first aspect, an embodiment of the present application provides a telescopic device, including:

a first U-shaped connector with a plurality sets of adjustment slots defined in two sides thereof and arranged along an adjustment direction;

a second U-shaped connector defining first through holes in two sides thereof, the second U-shaped connector being inserted into the first U-shaped connector, an U-shaped opening of the first U-shaped connector and an U-shaped opening of the second U-shaped connector being opposite to each other, so as to define an accommodating space;

a first spring being located in the accommodating space and abutting against the first U-shaped connector and the second U-shaped connector, respectively;

an elastic pin with two ends thereof extending through the first through holes at the two sides and engaging into one of the plurality sets of adjustment slots, the elastic pin being adjustable unidirectionally among the plurality of sets of adjustment slots which are arranged along the adjustment direction under a pushing force of the first spring; and an initial fixing pin being detachably connected to the first U-shaped connector and the second U-shaped connector, wherein when the fixing pin connects the first and second U-shaped connectors, the first spring is in a compressed state; and when the fixing pin is disassembled, the first spring provides the pushing force and the elastic pin is adjusted unidirectionally to a balanced position among the plurality sets of adjustment slots which are arranged along the adjustment direction.

Optionally, each of the plurality sets of adjustment slots is a rectangular slot.

Optionally, each of the first through holes is a circular through hole or a square through hole.

Optionally, the telescopic device further includes a pair of guiding sleeves fixed to the first U-shaped connector and the second U-shaped connector, respectively, and the first spring being arranged in the pair of guiding sleeves.

Optionally, the first spring includes two first springs symmetrically arranged in the accommodating space, and the elastic pin is located at a middle position between the two first springs.

Optionally, the elastic pin includes a second spring and pin heads fixed at two ends of the second spring, respectively, and an end face of each of the pin heads is provided with a guiding wedge surface and an anti-rotation plane.

Optionally, the end face of each of the pin heads is further provided with a groove for rotation of the pin head.

Optionally, the first U-shaped connector and the second U-shaped connector both are provided with second through holes, and the initial fixing pin is detachably engaged into the second through holes.

On a second aspect, an embodiment of the present application provides a telescopic annular tunnel steel arch, including: two lower arches, and two telescopic devices as defined in the first aspect, two ends of the upper arch being connected to the two lower arches through the two telescopic devices, respectively.

Optionally, one end of the upper arch is fixedly connected to the first U-shaped connector, and one end of the lower arch is fixedly connected to the second U-shaped connector; or, one end of the upper arch is fixedly connected to the second U-shaped connector, and one end of the lower arch is fixedly connected to the first U-shaped connector.

Technical solutions provided by the embodiments of this application may have the following beneficial effects: the first spring abuts against the first U-shaped connector and the second U-shaped connector, respectively, and is located inside the accommodating space; and two ends of the elastic pin extend through the first through holes at the two sides and engage into one of the plurality sets of adjustment slots. Under the action of the pushing force of the first spring, the elastic pin may be adjusted unidirectionally among the plurality of sets of adjustment slots which are arranged along the adjustment direction. After the initial fixing pin is disassembled, the first spring provides the pushing force, and the elastic pin is adjusted unidirectionally to the balanced position among the plurality sets of adjustment slots which are arranged along the adjustment direction, thereby overcoming the problem that the annular steel arch is difficult to expand and contract, and thus achieving the scalability of the annular steel arch, which can adapt to the dynamic changes of pressure and deformation of the surrounding rocks, increase the fit between the steel arch and the surrounding rocks, control the deformation of the surrounding rocks, and enhance the overall stiffness and support capacity of the steel arch.

It should be understood that the above general description and the following detailed description are only illustrative and explanatory, and do not limit the present application.

BRIEF DESCRIPTION OF THE DRAWINGS

Append drawings here are incorporated into the specification and form a part of this specification, and show embodiments in accordance with the present application, and are used in combination with the specification to explain the principles of the present application.

In the drawings.

1, telescopic device; 11, first U-shaped connector; 111, adjustment slot; 12, second U-shaped connector; 121, first through hole; 13, first spring; 14, elastic pin; 141, second spring; 142, pin head; 143, guiding wedge surface; 144, anti-rotation plane; 15, initial fixing pin; 16, accommodating space; 17, guiding sleeve; 18, second through hole; 2, upper arch; 3, lower arch; 4, first connecting baseplate; 5, second connecting baseplate.

DESCRIPTION OF THE EMBODIMENTS

Detailed description to exemplary embodiments will be given here, wherein the exemplary embodiments are shown in the append drawings. When the following description refers to the append drawings, unless otherwise indicated, the same numbers in different drawings represent the same or similar elements. Implementation manners described in the following exemplary embodiments do not represent all implementation manners consistent with the present application. Instead, they are only examples of devices and methods that are consistent with some aspects of the present application as detailed in the attached claims.

The terms used in this application are only for the purpose of describing specific embodiments and are not intended to limit this application. The singular forms of "a/an", "said", and "the" used in this application and the attached claims are also intended to include the majority form, unless the context clearly indicates other meanings. It should also be understood that the term "and/or" used in this specification refers to and includes any or all possible combinations of one or more related listed items.

It should be understood that although the terms "first", "second", "third", and etc. may be used in this application to describe various information, this information should not be limited by these terms. These terms are only used to distinguish the same type of information from each other. For example, without departing from the scope of this application, the first information may also be referred to as the second information, and similarly, the second information may also be referred to as the first information. Depending on the context, the word "if" used here may be interpreted as "at the time of . . . " or "when . . . " or "in response to . . . ".

Figure 1:
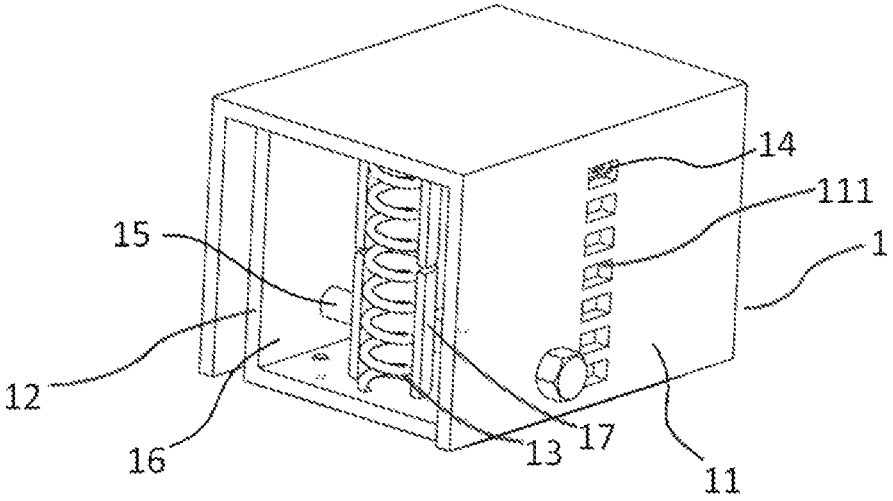
FIG. 1 is a schematic view of a telescopic device according to an exemplary embodiment, wherein a guiding sleeve has been cut open.
Figure 2:
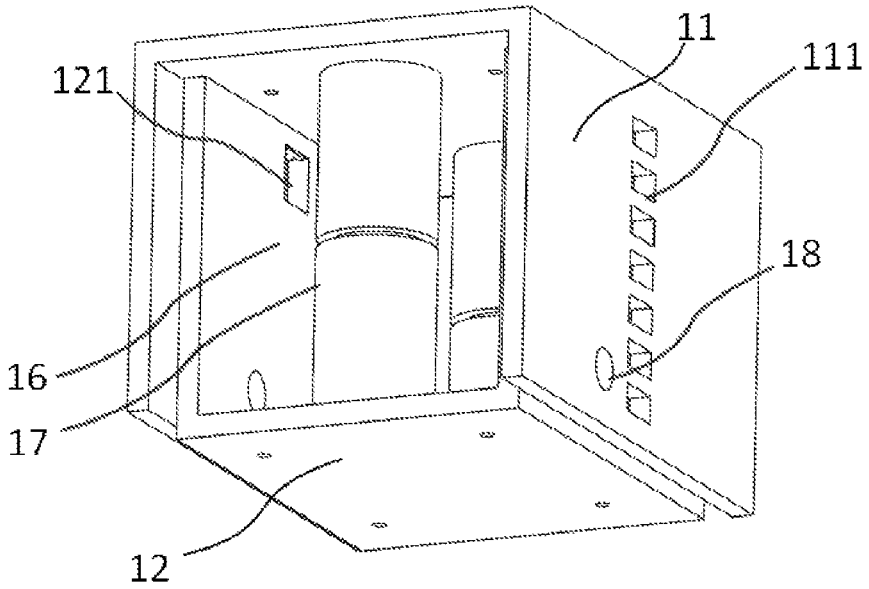
FIG. 2 is a schematic view of a telescopic device according to an exemplary embodiment, wherein an initial fixing pin is not shown.
Figure 3:
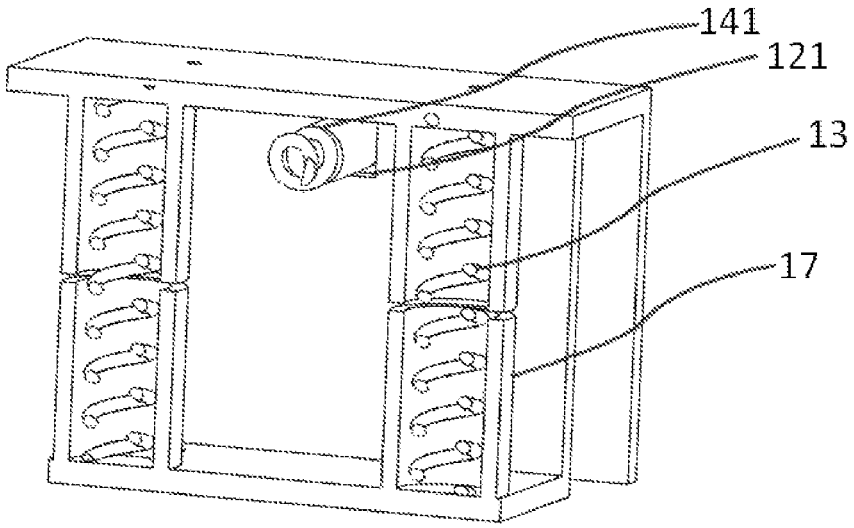
FIG. 3 is a schematic, cross sectional view of FIG. 1.

Referring to FIG. 1 to FIG. 3, an embodiment of the present application provides a telescopic device, which may include: a first U-shaped connector 11, a second U-shaped connector 12, a first spring 13, an elastic pin 14, and an initial fixing pin 15. A plurality sets of adjustment slots 111 are defined at two sides of the first U-shaped connector 11 and arranged along an adjustment direction. First through holes 121 are defined at two sides of the second U-shaped connector 12, respectively. The second U-shaped connector 12 is inserted into the first U-shaped connector 11, wherein an U-shaped opening of the first U-shaped connector 11 and an U-shaped opening of the second U-shaped connector 12 are opposite to each other, so as to form an accommodating space 16. The first spring 13 abuts against the first U-shaped connector 11 and the second U-shaped connector 12, respectively, and is located inside the accommodating space 16. Two ends of the elastic pin 14 extend through the first through holes 121 at the two sides and engage into one of the plurality sets of adjustment slots 111. Under an action of a pushing force of the first spring 13, the elastic pin 14 may be adjusted unidirectionally among the plurality sets of adjustment slots 111 which are arranged along the adjustment direction. The initial fixing pin 15 is detachably connected to the first U-shaped connector 11 and the second U-shaped connector 12. When the initial fixing pin 15 is connected to the first U-shaped connector 11 and the second U-shaped connector 12, the first spring 13 is in a compressed state. After the initial fixing pin 15 is disassembled, the first spring 13 provides the pushing force, and the elastic pin 14 is adjusted unidirectionally to a balanced position among the plurality sets of adjustment slots 111 which are arranged along the adjustment direction.

From the above embodiment, it can be seen that the first spring of the present application abuts against the first U-shaped connector and the second U-shaped connector, respectively, and is located inside the accommodating space; and the two ends of the elastic pin extend through the first through holes at the two sides and engage into one of the plurality sets of adjustment slots. Under the action of the pushing force of the first spring, the elastic pin may be adjusted unidirectionally among the plurality of sets of adjustment slots which are arranged along the adjustment direction. After the initial fixing pin is disassembled, the first spring provides the pushing force, and the elastic pin is adjusted unidirectionally to the balanced position among the plurality sets of adjustment slots which are arranged along the adjustment direction, thereby overcoming the problem that the annular steel arch is difficult to expand and contract, and thus achieving the scalability of the annular steel arch, which can adapt to the dynamic changes of pressure and deformation of the surrounding rocks, increase the fit between the steel arch and the surrounding rocks, control the deformation of the surrounding rocks, and enhance the overall stiffness and support capacity of the steel arch.

Figure 4:
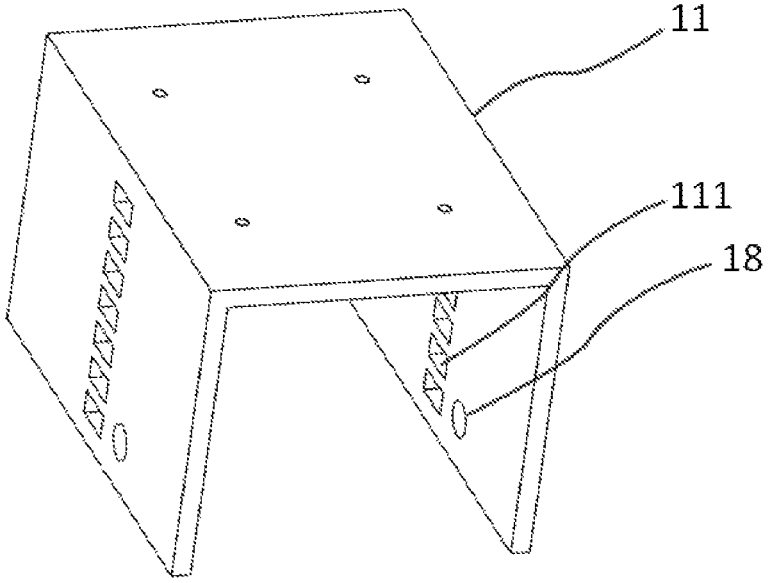
FIG. 4 is a schematic view of a first U-shaped connector according to an exemplary embodiment.
Figure 5:
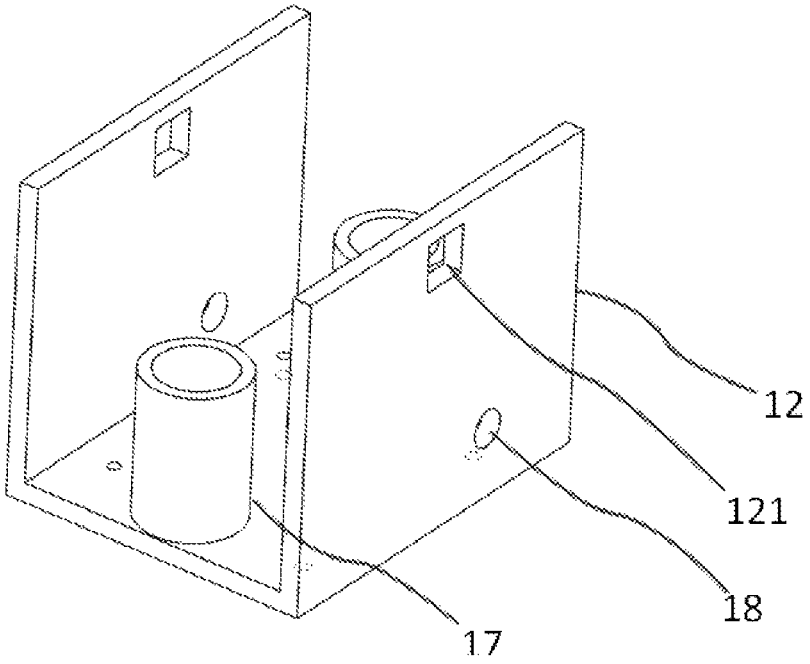
FIG. 5 is a schematic view of a second U-shaped connector according to an exemplary embodiment.

Referring to FIG. 4 and FIG. 5, the first U-shaped connector 11 and the second U-shaped connector 12 may be U-shaped steel with one of them mounted around the other one. U-shaped openings of the two U-shaped steels are opposite to each other to form the accommodating space 16. Arrangement of the U-shaped openings of the two U-shaped steels opposite to each other is for facilitating relative movement in the future.

Referring to FIG. 1, the plurality sets of adjustment slots 111, which are arranged along the adjustment direction, are generally arranged in a straight line array evenly spaced from each other, which can achieve gradual and uniform adjustment of the telescopic distance between the first U-shaped connector 11 and the second U-shaped connector 12, making the telescopic device more in line with objective laws during the telescopic process.

Referring to FIG. 2 and FIG. 3, in order to facilitate the fixation of the first spring 13, a pair of guiding sleeves 17 is provided and fixed to the first U-shaped connector 11 and the second U-shaped connector 12, respectively. The first spring 13 is arranged inside the pair of guiding sleeves 17, which may also restrict the expansion and contraction of the first spring 13. When an overall balance is reached, the guiding sleeves 17 may also play a role in supporting the stability of the whole framework.

Referring to FIG. 3, in order to achieve even stress, there are two first springs 13 which are symmetrically arranged in the accommodating space 16. The elastic pin 14 is located in a middle position between the two first springs 13. Of course, there may be even numbered first springs 13, such as four and etc., which need to be evenly and symmetrically arranged.

Figure 6:
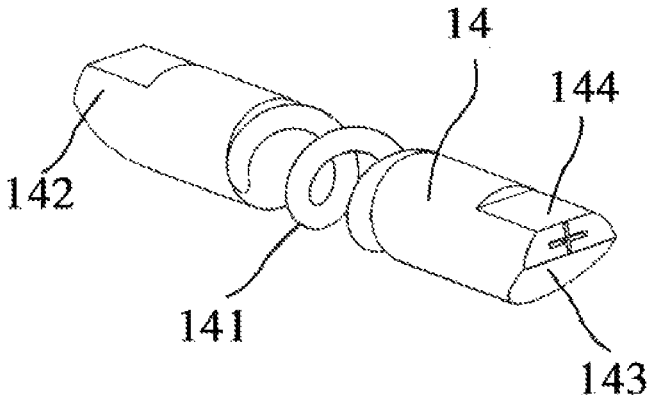
FIG. 6 is a schematic view of an elastic pin according to an exemplary embodiment.

Referring to FIG. 1 and FIG. 6, the elastic pin 14 includes a second spring 141 and pin heads 142 fixed at two ends of the second spring 141, respectively. An end face of each pin head 142 is provided with a guiding wedge surface 143 and an anti-rotation plane 144. Specifically, in order to achieve the stability of the elastic pin 14 in the adjustment slot 111, the adjustment slot 111 is generally a rectangular slot, so that the anti-rotation plane 144 attaches to upper or lower surface of the rectangular slot. An object of setting the adjustment slot 111 as a rectangular slot is to contact the anti-rotation plane 144 at the end face of the pin head 142, thereby achieving a self-locking effect between the planes. The guiding wedge surface 143 provided on the end face of the pin head 142 is angled with the rectangular slot, so that relative movement may be generated therebetween.

The two pin heads 142 extend through the first through holes 121 at two sides of the second U-shaped connector 12 and engage into one of the plurality sets of adjustment slots 111. In an initial state, i.e., when the initial fixing pin 15 connects the first U-shaped connector 11 and the second U-shaped connector 12, the first spring 13 is in a compressed state. The pair of pin heads 142 may be engaged into one set of adjustment slots 111 at the top, and the anti-rotation planes 144 abut the upper surfaces of the set of adjustment slots 111. After the initial fixing pin 15 is disassembled, under the action of the pushing force of the first spring 13, the first U-shaped connector 11 and the second U-shaped connector 12 begin to separate from each other. The guiding wedge surfaces 143 firstly contact the lower surfaces of the set of adjustment slots 111 which give the guiding wedge surfaces 143 an inward pushing component-force under the action of the pushing force of the first spring 13, making the two pin heads 142 be pushed inwardly to compress the second spring 141. After encountering a next set of adjustment slots 111, the guiding wedge surfaces 143 enter that set of adjustment slots 111 or continue to adjust downwards until them reach the balanced position and engage into the corresponding set of adjustment slots 111. An object of setting the initial fixing pin 15 is to maintain the initial state of the device.

After achieving the separation of the first U-shaped connector 11 and the second U-shaped connector 12 through the above method, due to the anti-rotation planes 144 abutting against the upper surfaces of the set of adjustment slots 111, it is impossible to apply force to bring the first U-shaped connector 11 and the second U-shaped connector 12 closer to each other. In order to bring the first U-shaped connector 11 and the second U-shaped connector 12 closer to each other and return to the initial state, the end face of the pin head 142 is further provided with a groove for rotation of the elastic pin 14. By means of the groove, and by means of an existing tool cooperating with the groove, rotation of the pin head 142 is achieved. After rotating the pin head 142 by 180 degrees, a force that brings the first U-shaped connector 11 and the second U-shaped connector 12 closer to each other is applied, and then the pin heads 142 can move along a direction opposite to the adjustment direction of the adjustment slots 111 until them reach the initial position, and then the initial fixing pin 15 is inserted into the first U-shaped connector 11 and the second U-shaped connector 12 to lock them fixedly. Finally, the pin head 142 is rotated 180 degrees again by means of cooperating of the existing tool and the groove, thereby returning back to the initial state. The groove may be cross groove, straight groove, hexagonal groove, and etc., which can be used in conjunction with existing cross screwdrivers, straight screwdrivers or hexagonal wrenches. In this embodiment, a cross groove is shown in the drawings. An object of setting the cross groove is to facilitate the user to control the device to expand and contract unidirectionally through rotation of the pin head 142.

The first through holes 121 are mainly for extending of the pin heads 142 therethrough and providing support for the pin heads 142. Generally, the pin head 142 is column-shaped, and thus the first through hole 121 may be a circular through hole or a square through hole. The circular through hole matches perfectly with the column-shaped pin head 142, and four sides of the square through hole may also form a tangent fit with the column-shaped pin head 142. An object of using column-shaped pin head 142 is to make the whole pin head have an ability to rotate.

The first U-shaped connector 11 and the second U-shaped connector 12 are both provided with second through holes 18, and the initial fixing pin 15 is detachably engaged into the second through holes 18. An object of mounting the fixing pin 15 is to lock the device at any time.

Figure 7:
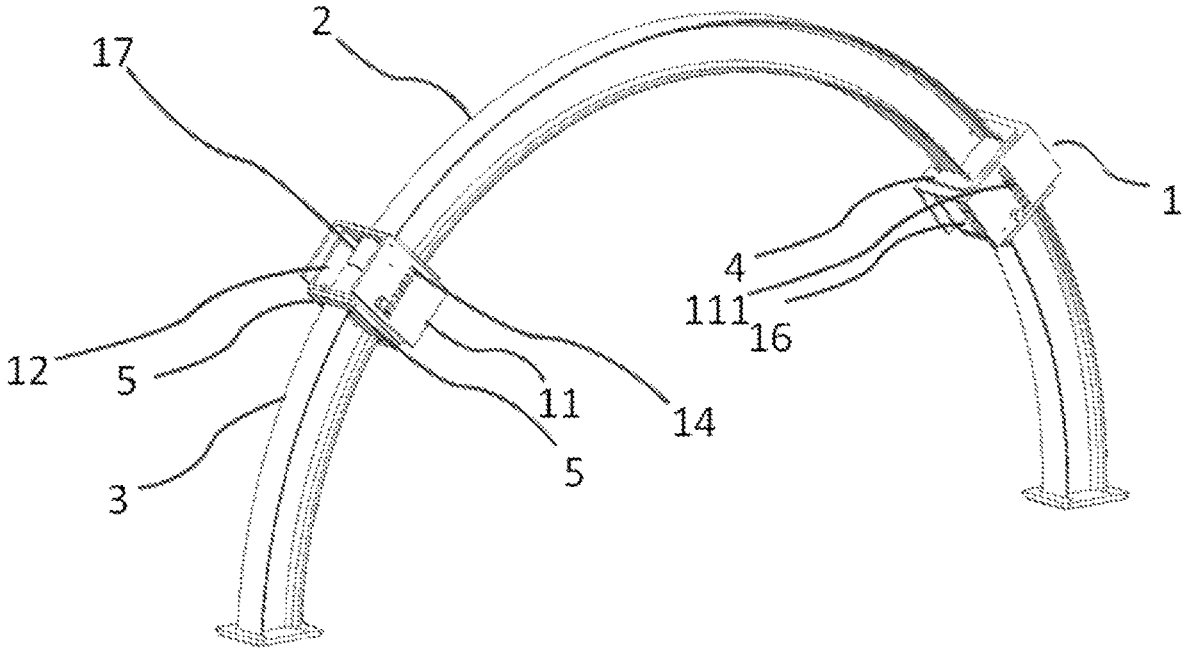
FIG. 7 is a schematic view of a telescopic annular tunnel steel arch according to an exemplary embodiment.

Referring to FIG. 7, an embodiment of the present application further provides a telescopic annular tunnel steel arch, which may include two aforementioned telescopic devices 1, an upper arch 2 and two lower arches 3. Two ends of the upper arch 2 are connected to the two lower arches 3 through the two telescopic devices 1, respectively.

From the above embodiment, it can be seen that the present application, which utilizes the above telescopic devices, is able to contract through contraction of the steel arch after excavation of the tunnel, so as to provide a certain, constant resistance to stabilize the deformation of the surrounding rocks; and can continue to support the surrounding rocks in a rigid arch manner after the contraction is completed, That is, by introducing "flexibility" to adapt to the large deformation of the tunnel surrounding rocks.

Figure 8:
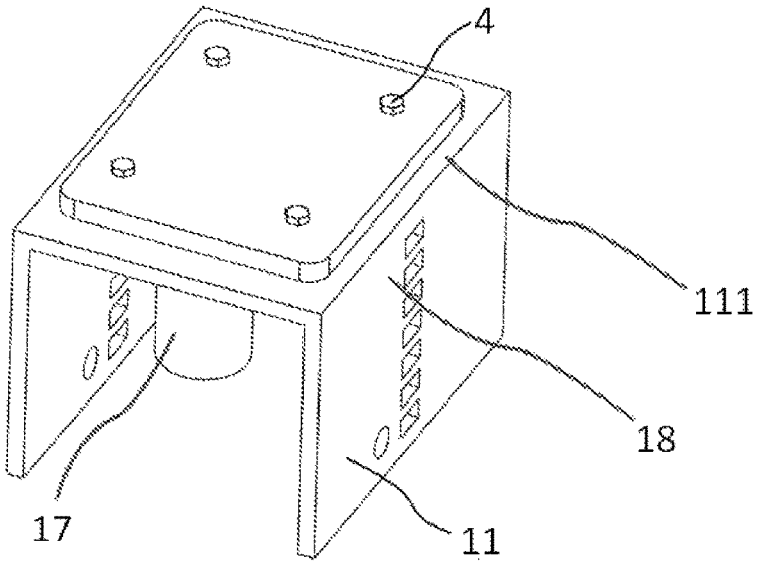
FIG. 8 is a schematic view of the first U-shaped connector connected with a first connecting baseplate according to an exemplary embodiment.

Referring to FIG. 8, one end of the upper arch 2 is fixedly connected to a first connecting baseplate 4, and one end of the lower arch 3 is fixedly connected to a second connecting baseplate 5; or, one end of the upper arch 2 is fixedly connected to the second connecting baseplate 5, and one end of the lower arch 3 is fixedly connected to the first connecting baseplate 4. The connecting baseplate plays a critical role in connecting the U-shaped connector and the steel arch.

Figure 9:
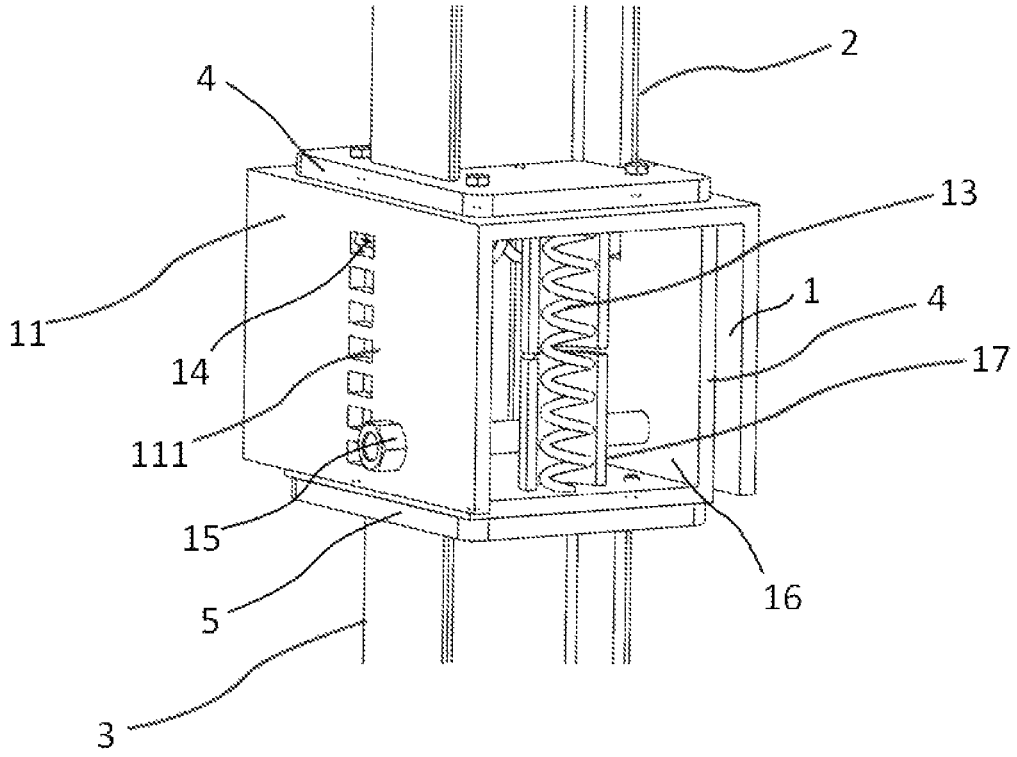
FIG. 9 is a schematic view of the telescopic device connected to upper and lower arches according to an exemplary embodiment.
Figure 10:
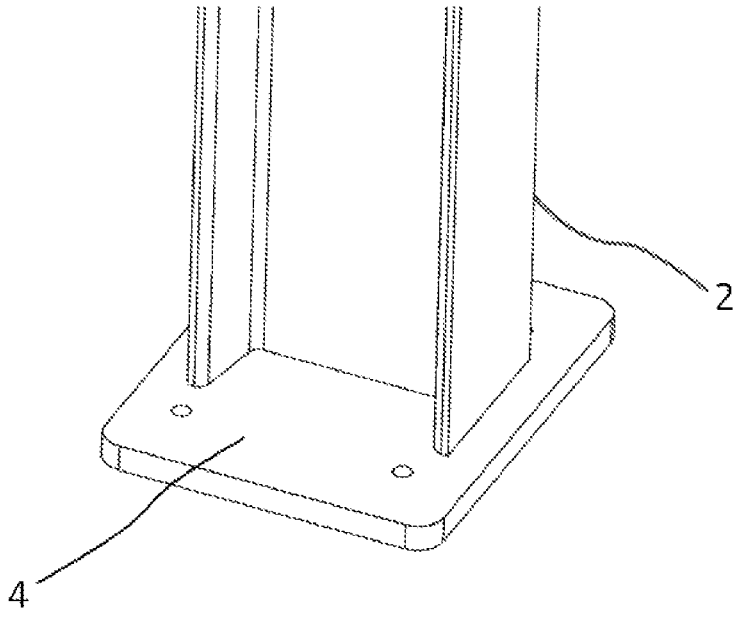
FIG. 10 is a schematic view of the upper arch connected the first connecting baseplate according to an exemplary embodiment.
Figure 11:
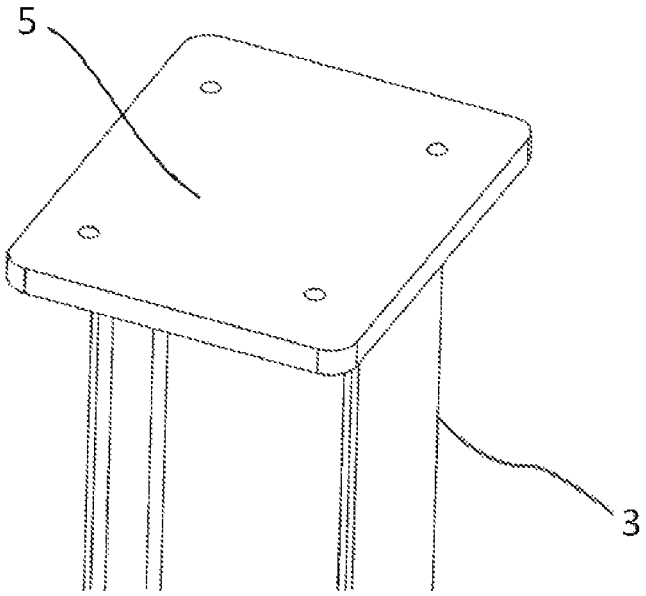
FIG. 11 is a schematic view of the lower arch connected to a second connecting baseplate according to an exemplary embodiment.

Referring to FIG. 9 to FIG. 11, the first U-shaped connector 11 and the second U-shaped connector 12 are fixedly connected with a first connecting baseplate 4 and a second connecting baseplate 5, respectively. For example, one end of the upper arch 2 is welded to the first connecting baseplate 4, and one end of the lower arch 3 is welded to the second connecting baseplate 5. The connecting baseplate plays a critical role in connecting the U-shaped connector and the steel arch.

During in use, left and right sidewalls of the telescopic annular tunnel steel arch are respectively equipped with the telescopic devices that are maintained in the initial state by the initial fixing pins 15. After removing the initial fixing pin 15, the compressed first spring 13 begins to release pressure, and the elastic pin 14 is adjusted unidirectionally to the balanced position among the plurality sets of adjustment slots 111 which are arranged along the adjustment direction, and the pin heads 142 are engaged into the corresponding set of adjustment slots 111 to lock the first U-shaped connector 11 and the second U-shaped connector 12. Such state is stretch of the whole node. The pin head is rotated 180 degrees by a cross screwdriver, and a motion at this time is exactly opposite to that of stretch, achieving the purpose of compression.

After considering the content disclosed in the specification and practice, it is easy to think of other implementation manners for this application. The purpose of this application is to cover any variations, uses, or adaptive changes of this application, which follow the general principles of this application and include common knowledge or commonly used technical means in the technical field that are not disclosed in this application. The specification and embodiments are only considered exemplary, and the actual scope and spirit of this application are indicated by the claims.

It should be understood that this application is not limited to the precise structure already described above and shown in the append drawings, and various modifications and changes may be made without departing from its scope. The scope of this application is limited only by the attached claims.

What is claimed is:

1. A telescopic device, comprising:

a first U-shaped connector with a plurality sets of adjustment slots defined in two sides thereof and arranged along an adjustment direction;

a second U-shaped connector defining first through holes in two sides thereof, the second U-shaped connector being inserted into the first U-shaped connector, an U-shaped opening of the first U-shaped connector and an U-shaped opening of the second U-shaped connector being opposite to each other, so as to define an accommodating space;

a first spring being located in the accommodating space and abutting against the first U-shaped connector and the second U-shaped connector, respectively;

an elastic pin with two ends thereof extending through the first through holes at the two sides and engaging into one of the plurality sets of adjustment slots, the elastic pin being adjustable unidirectionally among the plurality of sets of adjustment slots which are arranged along the adjustment direction under a pushing force of the first spring; and an initial fixing pin being detachably connected to the first U-shaped connector and the second U-shaped connector, wherein when the fixing pin connects the first and second U-shaped connectors, the first spring is in a compressed state; and when the fixing pin is disassembled, the first spring provides the pushing force and the elastic pin is adjusted unidirectionally to a balanced position among the plurality sets of adjustment slots which are arranged along the adjustment direction.

2. The telescopic device according to claim 1, wherein each of the plurality sets of adjustment slots is a rectangular slot.

3. The telescopic device according to claim 1, wherein each of the first through holes is a circular through hole or a square through hole.

4. The telescopic device according to claim 1, further comprising a pair of guiding sleeves fixed to the first U-shaped connector and the second U-shaped connector, respectively, and the first spring being arranged in the pair of guiding sleeves.

5. The telescopic device according to claim 1, wherein the first spring comprises two first springs symmetrically arranged in the accommodating space, and the elastic pin is located at a middle position between the two first springs.

6. The telescopic device according to claim 1, wherein the elastic pin comprises a second spring and pin heads fixed at two ends of the second spring, respectively, and an end face of each of the pin heads is provided with a guiding wedge surface and an anti-rotation plane.

7. The telescopic device according to claim 6, wherein the end face of each of the pin heads is further provided with a groove for rotation of the pin head.

8. The telescopic device according to claim 1, wherein the first U-shaped connector and the second U-shaped connector both are provided with second through holes, and the initial fixing pin is detachably engaged into the second through holes.

9. A telescopic annular tunnel steel arch, comprising: an upper arch, two lower arches, and two telescopic devices according to any one of claims 1-8, two ends of the upper arch being connected to the two lower arches through the two telescopic devices, respectively.

10. The telescopic annular tunnel steel arch according to claim 9, wherein one end of the upper arch is fixedly connected to the first U-shaped connector, and one end of the lower arch is fixedly connected to the second U-shaped connector; or, one end of the upper arch is fixedly connected to the second U-shaped connector, and one end of the lower arch is fixedly connected to the first U-shaped connector.

* * * * *